US005911369A

United States Patent [19]

Yamazaki

[11] Patent Number: 5,911,369

[45] Date of Patent: Jun. 15, 1999

[54] PULL-TAB CONNECTOR FOR SLIDE-FASTENER SLIDER

[75] Inventor: Miki Yamazaki, Toyama-ken, Japan

[73] Assignee: YKK Corporation, Tokyo, Japan

[21] Appl. No.: 09/162,991

[22] Filed: Sep. 30, 1998

[30] Foreign Application Priority Data

Sep. 30, 1997 [JP] Japan ..... 9-266531

[51] Int. Cl.[6] ..... A44B 19/00

[52] U.S. Cl. ..... 24/429; 24/419

[58] Field of Search ..... 24/419, 429, 430, 24/431, 437, 381

[56] References Cited

U.S. PATENT DOCUMENTS 4,790,050 12/1988 Ishii ..... 24/429
5,067,209 11/1991 Terada et al. ..... 24/429
5,347,692 9/1994 Ebata ..... 24/429
5,416,951 5/1995 Keyaki et al. ..... 24/429

*Primary Examiner*—Victor N. Sakran
*Attorney, Agent, or Firm*—Hill & Simpson

[57] ABSTRACT

A pull-tab connector for attaching a pull tab's round strap to a slider body is composed of a connector body and a connecting ring on one end of the connector body. The connector body has a transverse through-hole t a side toward the connecting ring, and a pair of longitudinal strap-insertion holes communicating with and perpendicularly to the transverse through-hole and opening to the other end of the connector body and to opposite sides of the connector body via a pair of inwardly tapering longitudinal inlet openings. The strap is inserted through the transverse through-hole and then forced into the longitudinal holes from the respective inlet openings, whereupon opposite ends of the strap are laterally aligned and then pulled to tighten the strap. Thus the strap can be threaded through the connector body simply and neatly, and the threaded strap can be exchanged with another as a demand arises.

14 Claims, 8 Drawing Sheets

PULL-TAB CONNECTOR FOR SLIDE-FASTENER SLIDER

BACKGROUND OF THE INVENTION

1. Field of the Invention

The present invention relates to a pull-tab connector for connecting a pull tab in the form of a round strap to a slider body of a slide fastener slider.

2. Description of the Related Art

FIG. 14 of the accompanying drawings shows a conventional pull-tab connector of this type. The pull-tab connector comprises a plate-like pull tab 26' having at one end a connecting hole 40' to be attached to an attachment lug of a slider body and at the other end a comb-like grip portion 31' provided with a number of through-holes 3' through which a flat strap 25' is fixedly threaded meanderingly.

Japanese Utility Model Laid-Open Publication No. Hei6-50514 discloses a pull-tab connector, as shown in FIG. 15 of the accompanying drawings. The pull tab connector comprises a clamp member 50" in the form of a pair of rectangular holder plates 52" interconnected at one side by a neck 57" and having on each of their confronting inner surfaces a pair of grooves having projections, a connecting ring 4" connected to the neck 57" of the clamp member 50" and adapted to be attached to the slider body, and a round strap 25" of which ends are received in the grooves and clamped between the holder plates 52" of the clamp member 50".

According to the first-named conventional pull-tab connector of FIG. 14, although the pull tab 26 can be manufactured in a very simple manner, smooth turning and threading of the strap 25' with respect to the pull tab 26' is difficult to achieve. Also the strap 25' threaded through the grip portion 31' of the pull tab 26' partly protrude from the opposite pull tab surfaces making the pull tab unsightly.

According to the second-named conventional pull-tab connector of FIG. 15, although the ends of the round strap 25" can be secured to the clamp member 50" firmly and neatly, it is laborious and time-consuming to attach the strap 25" to the clamp member 50". Besides, once the ends of the strap 25" has been attached to the clamp member 50", it is difficult to exchange the strap 25" with another.

SUMMARY THE INVENTION

With the foregoing problems in view, a first object of the present invention is to provide a pull-tab connector, for a slide fastener slider, in which an exchangeable round strap of a pull tab can be attached to a slider body simply and threaded through and turned in a connector body simply and neatly without causing the strap to project partly from the surfaces of the connector body. Further, the round strap can be fitted into the connector body by being inserted and forced into a transverse strap-insertion through-hole and then a pair of longitudinal strap-insertion holes after turning around an inter-hole partition of the connector body, from opposite sides via the associated inlet openings.

A second object of the invention is to provide a pull-tab connector for a slide fastener slider, in which the round strap can be threaded through and turned in any of various types of connector bodies simply by specifying the respective shapes of the transverse strap-insertion through-hole, longitudinal strap-insertion holes and longitudinal inlet openings.

A third object of the invention is to provide a pull-tab connector for a slide fastener slider, which is in a separable form having annular and radial strap-insertion holes on its inner surfaces, thus facilitating the manufacturing of the connector.

A fourth object of the invention is to provide a pull-tab connector for a slide fastener slider, in which the pull-tab connector can be attached to the slider body stably, and which facilitates operating and handling various types of sliders by a specific form of connecting ring.

In order to accomplish the foregoing objects, according to a first aspect of the invention, there is provided a pull-tab connector for connecting a round strap of a pull tab to a slide fastener slider, comprising: a connector body; and a connecting ring disposed on one end of the connector body and adapted to be attached to the slide fastener slider; the connector body having a transverse strap-insertion through-hole, a pair of longitudinal strap-insertion holes communicating at their inner ends with the transverse strap-insertion through-hole and opening at their outer ends to the other end of the connector body opposite to the connecting ring, and a pair of inwardly tapering longitudinal inlet openings each communicating at its inner side with a respective one of the longitudinal strap-insertion holes through its entire length and opening at its outer side to an outer surface of the connector body through its entire length.

According to a second aspect of the invention, it is preferable that the longitudinal strap-insertion holes open in opposite directions to opposite sides of the connector body via the respective longitudinal inlet openings.

Alternatively, according to a third aspect of the invention, the connector body has an inwardly tapering transverse rear inlet opening communicating at its inner side with the transverse strap-insertion through-hole and opening at its outer side to a rear side of the connector body, the longitudinal strap-insertion holes opening to the rear side of the connector body via the respective longitudinal inlet openings.

Still alternatively, according to a fourth aspect of the invention, the connector body has an inwardly tapering transverse rear inlet' opening communicating at its inner side with the transverse strap-insertion through-hole and opening at its outer side to a rear side of the connector body.

According to a fifth aspect of the invention, it is preferable that the connector body has a right-angle hexahedral contour.

Alternatively according to a sixth aspect of the invention, the connector body may have a cylindrical contour with one hemispherical end.

Still alternatively, according to a seventh aspect of the invention, the connector body may have a spherical contour According to an eighth aspect of the invention, the longitudinal strap-insertion holes preferably merge at their outer ends.

According to a ninth aspect of the invention, it is preferable that the connecting ring is fixed to the connector body.

Or alternatively, according to a tenth aspect of the invention, the connecting ring may be pivotally mounted on the connector body.

According to an eleventh aspect of the invention, there is provided a pull-tab connector for connecting a round strap of a pull tab to a slide fastener slider, comprising: an annular connector body having a hub; and a connecting ring disposed on an outer periphery of the connector body and adapted to be attached to the slide fastener slider; the connector body having an annular strap-insertion hole about the hub, a radially inwardly tapering annular peripheral inlet opening communicating at its inner side with the annular strap-insertion hole and opening at its outer side to the outer periphery of the connector body, and a radial strap-insertion hole disposed on a side opposite to the connecting ring and a round strap of a pull tab to a slide fastener slider, comprising: a connector body having a hub; and a connecting ring disposed on an outer periphery of the connector body and adapted to be attached to the slide fastener slider; the connector body having an annular strap-insertion hole about the hub, a radially inwardly tapering annular peripheral inlet opening communicating at its inner side with the annular strap-insertion hole and opening at its outer side to the outer periphery of the connector body, and a radial strap-insertion hole disposed on a side opposite to the connecting ring and communicating at its inner end with the annular strap-insertion hole and opening at its outer end to the outer periphery of the connector body, the radial strap-insertion hole extending perpendicularly to the annular strap-insertion hole across the peripheral inlet opening.

According to a twelfth aspect of the inventions, it is preferable that the connector body is composed of separably coupled front and rear disc-like plates having in their confronting surfaces halves of the annular strap-insertion hole, halves of the peripheral inlet opening, halves of the radial strap-insertion hole, and on their confronting surfaces halves of the hub, one half of the hub having an axial hole and the other half of the hub having an axial projection to be fitted in the axial hole.

In the eleventh and twelfth aspects of the invention, according to a thirteenth aspect of the invention, the connecting ring is fixed to the connector body.

Alternatively, the connecting ring may be pivotally mounted on the connector body.

DETAILED DESCRIPTION OF THE PREFERRED EMBODIMENTS

The principles of the present invention are particularly useful when applied to a pull-tab connector for a slide fastener slider, various preferred embodiments of which will now be described in detail with reference to the accompanying drawings.

Figure 1:
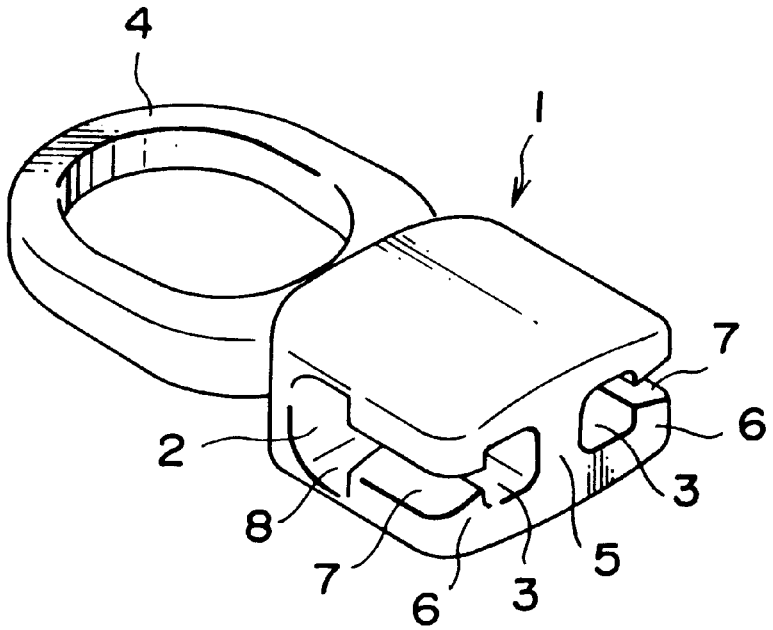
FIG. 1 is a perspective view of a right-angle hexahedral connector body of a pull-tab connector for a slide fastener slider, according to a first embodiment of the present invention.
Figure 2:
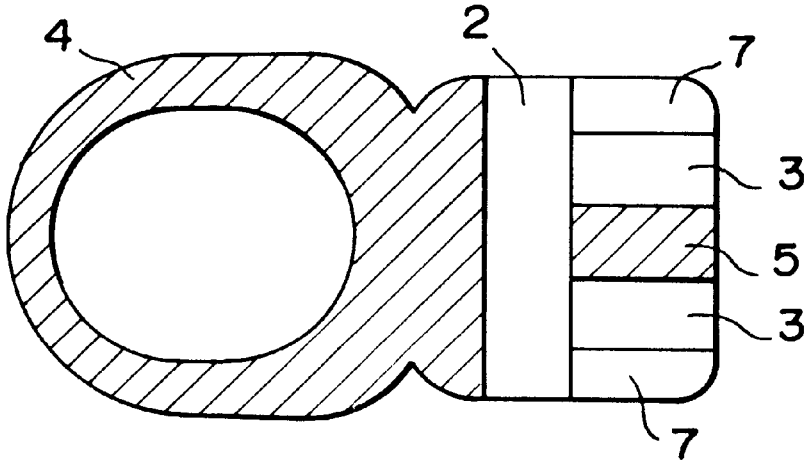
FIG. 2 is a longitudinal cross-sectional view, taken along an imaginary horizontal plane, of the hexahedral connector body of FIG. 1.
Figure 3:
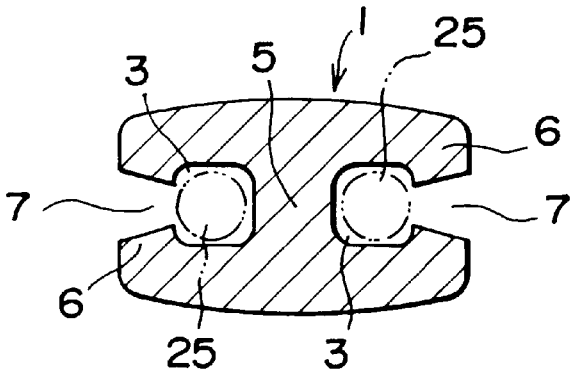
FIG. 3 is a transverse cross-sectional view, taken along an imaginary vertical plane, of the hexahedral connector body of FIG. 1.

FIGS. 1 through 3 show a pull-tab connector for a slide fastener slider, according to a first embodiment of the invention. The pull-tab connector of the first embodiment comprises a connector body 1 having a right-angle hexahedral contour, and a connector ring 4 integrally protecting from one end of the connector body 1 and adapted to be attached to a slider body S. As shown in FIG. 1, the connector body 1 has a transverse strap-insertion through-hole (hereinafter also called the transverse through-hole) 2 with a bottom 8, extending horizontally between opposite sides of the right-angle hexahedral contour at a position toward the connecting ring 4. The connector body 1 further has a laterally aligned pair of longitudinal strap-insertion holes (hereinafter also called the longitudinal holes) 3 communicating at their inner ends with the transverse through-hole 2 and opening at their outer ends to the other end of the connector body 1, defining an inter-hole partition wall 5 between the longitudinal holes 3. Further, the two longitudinal holes 3 respectively open to the opposite sides of the connector body 1 via a pair of inwardly tapering longitudinal side inlet openings 7 through their entire length; that is, each longitudinal inlet opening 7 communicates at its inner side with the respective longitudinal hole 3 through its entire length and with the transverse through-hole 2 at its inner end towards the connecting ring 4 and opens at its outer side to the corresponding side of the connector body 1 and at its outer end to the other end of the connector body 1. Each longitudinal opening 7 is defined by a pair of side walls 6 of the connector body 1.

The pull-tab connector, which is composed of the connector body 1 and the connecting ring 4, is manufactured in a unitary form by die-casting of metal such as aluminum alloy or zinc alloy. Alternatively, the pull-tab connector may be molded by injection molding using thermoplastic synthetic resin, such as polyamide, polyacetal, polypropylene or polybutylenetelephthalate, instead of metal.

Figure 4:
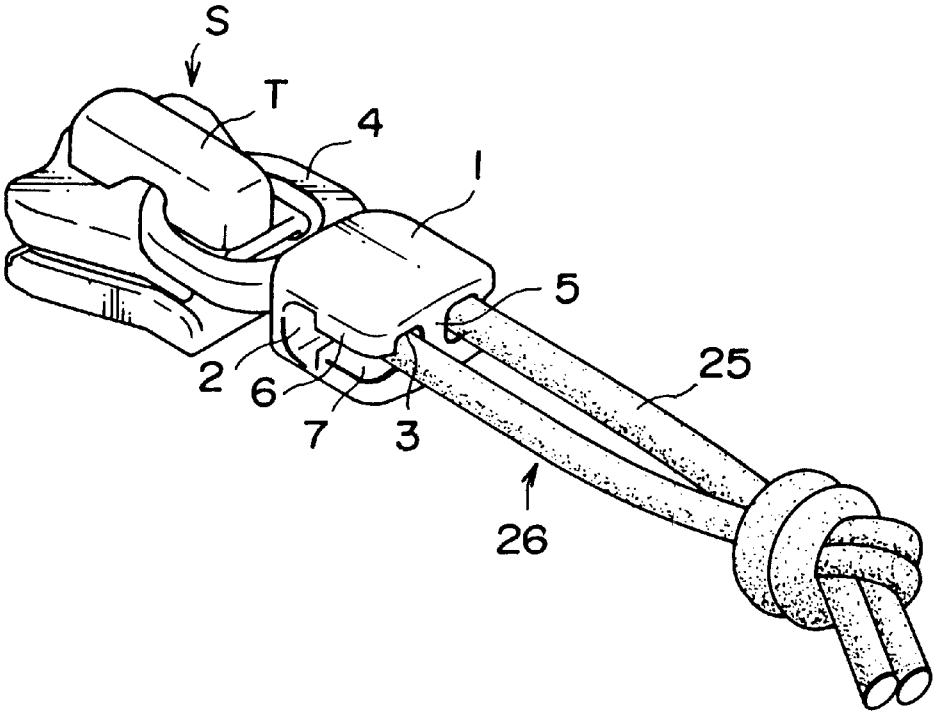
FIG. 4 is a perspective view showing the pull-tab connector of the first embodiment as attached to the slider.

The steps in which the strap 25 in the form of a round strip of FIG. 4 is threaded through and turned in the right-angle hexahedral connector body 1 will now be described. Firstly one end of the round strap 25 is inserted through the transverse through-hole 2 of the connector body 1 from one end. Then, the strap 25 is forced into the longitudinal holes 3 horizontally from opposite sides via the respective longitudinal openings 7 as indicated by dash-and-two-dot lines in FIG. 3 so as to form a loop turning round inner end of the inter-hole partition wall 5 and fixed in the connector body 1 with two ends of the strap 25 rendered in alignment with each other. Then, the two aligned ends of the strap 25 are knotted as shown in FIG. 4 or fastened by a non-illustrated clamp. In the meantime, the connector ring 4 is attached to the slider body S. Thus a pull tab 26 has been completed as shown in FIG. 4.

Figure 5:
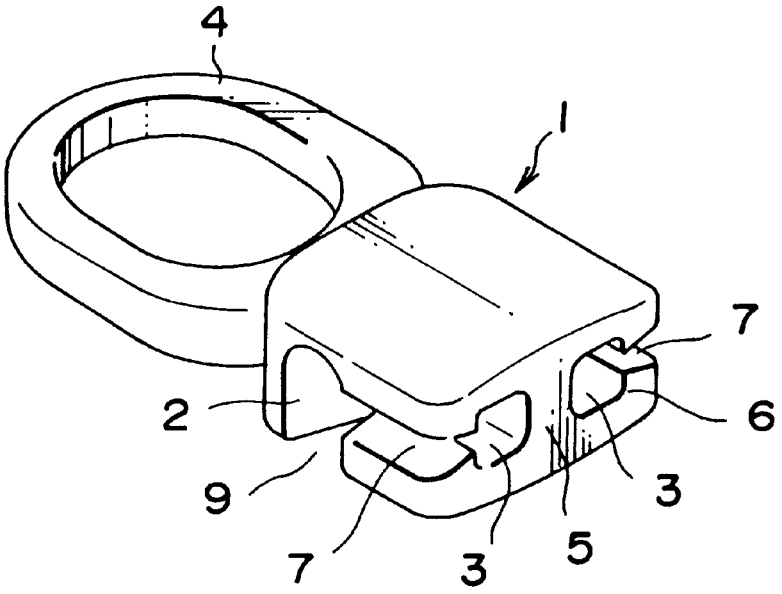
FIG. 5 is a perspective view of a right-angle hexahedral connector body of another pull-tab connector according to a second embodiment of the invention.
Figure 6:
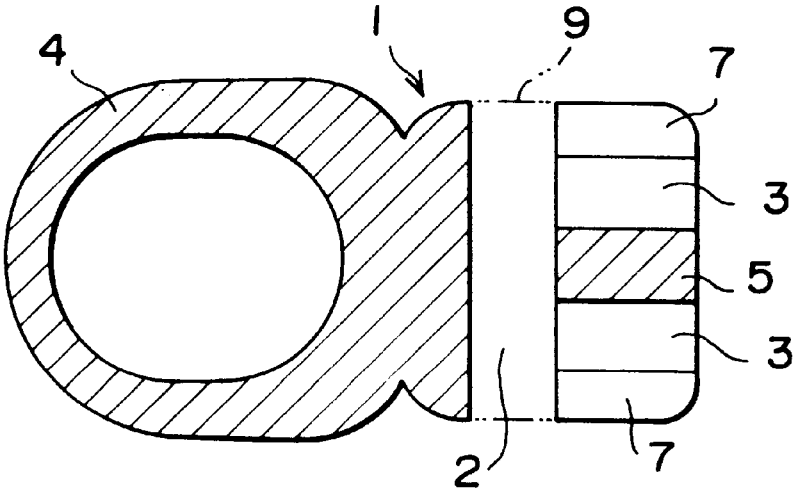
FIG. 6 is a longitudinal cross-sectional view, taken along an imaginary horizontal plane, of the hexahedral connector body of FIG. 5.

FIGS. 5 and 6 show another pull-tab connector according to a second embodiment of the invention. This embodiment is identical in structure with the first embodiment of FIGS. 1 through 3 except that a modified connector body 1 additionally has a transverse rear inlet opening 9 communicating with the transverse through-hole 2 through its entire length and opening to the rear side of the right-angle hexahedral connector body 1. The transverse rear opening 9 has a width equal to the diameter of the transverse through-hole 2, thus defining an inverted-U-shaped-cross-section in combination with the transverse hole 2 as shown in FIG. 5. A connecting ring 4 projects from the outer surface of one end the connector body 1 on the side toward the transverse through-hole 2.

For threading the round strap 25 through and turning it in the right-angle hexahedral connector body 1, firstly the round strap 25 is inserted laterally into the transverse through-hole 2 of the connector body 1 from the rear side via the transverse rear inlet opening 9. Then the strap 25 is forced laterally into the longitudinal holes 3 via the respective longitudinal inlet openings 7 to assume the same posture as indicated by dash-and-two-dot lines in FIG. 3 so as to form a loop turning round an inner end of the inter-hole partition wall 5 and fixed in the connector body 1 with two ends of the strap 25 rendered in alignment with each other. Then, the two aligned ends of the strap 25 are knotted as shown in FIG. 4 or fastened by a non-illustrated clamp. A non-illustrated anchoring ring may be threaded on the strap 25 so that the strap 25 can be prevented from being displaced in or removed off the connector body 1 by accident.

Figure 7:
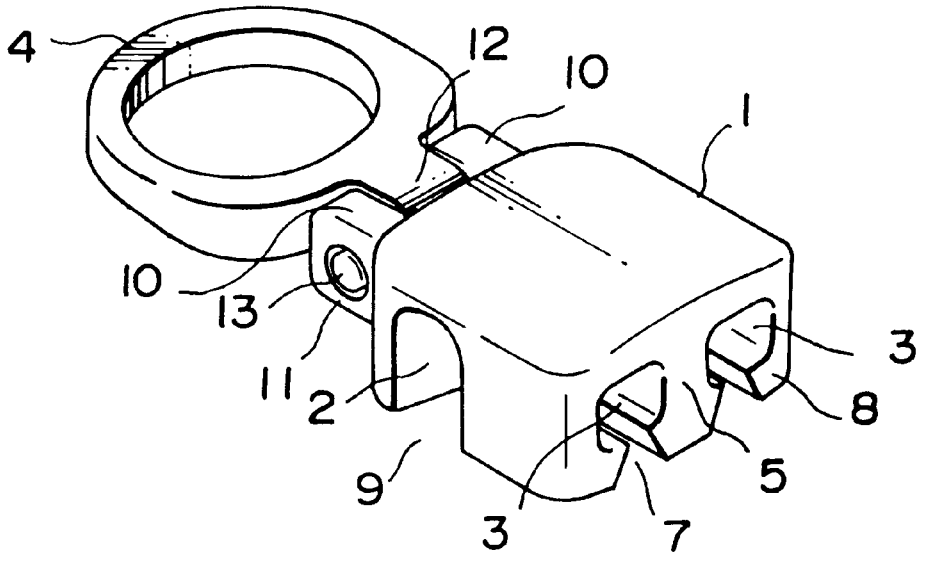
FIG. 7 is a perspective view of a right-angle hexahedral connector body of still another pull-tab connector according to a third embodiment of the invention.
Figure 8:
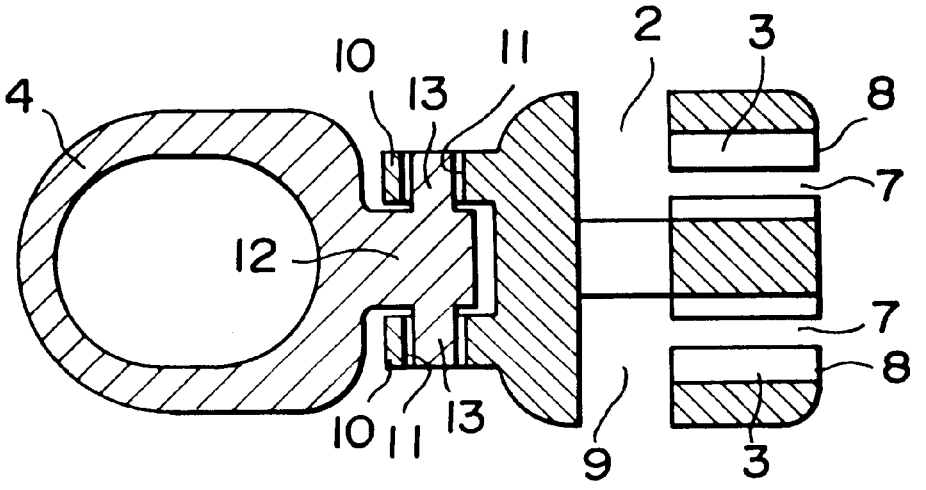
FIG. 8 is a longitudinal cross-sectional view, taken along an imaginary horizontal plane, of the hexahedral connector body of FIG. 7.

FIGS. 7 and 8 show still another pull-tab connector according to a third embodiment of the invention. This embodiment is differentiated from the first embodiment of FIGS. 1 through 3 in that a modified connector body 1 additionally has a transverse rear inlet opening 9 communicating with the transverse through-hole 2 through its entire length and opening to the rear side of the right-angle hexahedral connector body 1. The transverse rear inlet opening 9 is provided with a bottom only at its center, as shown in FIG. 8.

The transverse rear inlet opening 9 has a size equal to the size of the transverse through-hole 2, thus defining an inverted-U-shaped-cross-section in combination with the transverse through-hole 2 as shown in FIG. 7. A connecting ring 4 projects from an outer surface of one end the connector body 1 on the side toward the transverse through-hole 2. This embodiment is also differentiated from both of the first embodiment and the second embodiments in that the longitudinal inlet openings 7 of the previous embodiments are substituted by a pair of inwardly (upwardly in FIG. 7) tapering longitudinal rear inlet openings 7 communicating with the respective longitudinal holes 3 through their entire length and opening to the rear side of the right-angle hexahedral connector body 1 with bottoms 8 left; that is, each longitudinal rear inlet opening 7 communicates with the transverse through-hole 2 at its inner end toward the connecting ring 4 and opens at its outer end to the other end of the connector body 1.

Further, the connecting ring 4 is pivotally supported on one end of the connector body 1. Namely, a pair of pivots 13 projecting in opposite directions from a base 12 of the connector ring 4 are rotatably received in a pair of pivot holes 11 of a pair of bearing lugs 10 that project from the outer surface of the one end of the connector body 1.

The pull-tab connector, with the connecting ring 4 is pivotally supported on the connector body 1, is manufactured in a unitary form by die-casting using metal or by injection molding using thermoplastic synthetic resin.

For threading the round strap 25 through and turning it in the right-angle hexahedral connector body 1, firstly the round strap 25 is laterally inserted into the transverse through-hole 2 of the connector body 1 from the rear side via the transverse opening 9. Then, the strap 25 is forced into the longitudinal holes 3 from the rear side via the respective longitudinal inlet openings 7 so as to form a loop turning around the inner end of the inter-hole partition wall 5 and fixed in the connector body 1 with two ends of the strap 25 rendered in alignment with each other. Then, the two aligned ends of the strap 25 are knotted as shown in FIG. 4 or fastened by a non-illustrated clamp, completing the pull-tab connector.

Figure 9:
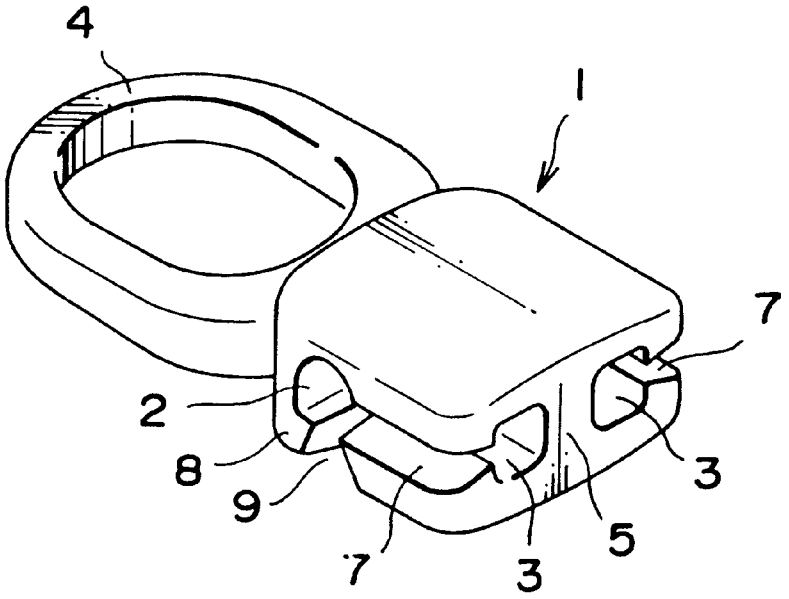
FIG. 9 is a perspective view of a right-angle hexahedral connector body of a further pull-tab connector according to a fourth embodiment of the invention.

FIG. 9 shows a further pull-tab connector according to a fourth embodiment of the invention. This embodiment is differentiated from the second embodiment of FIGS. 5 and 6 only in that the transverse rear inlet opening 9 has partly a bottom inwardly (upwardly in FIG. 9) tapering toward the transverse through-hole 2.

For threading the round strap 25 through and turning it in the right-angle hexahedral connector body 1, firstly the round strap 25 is forced laterally into the transverse through-hole 2 of the connector body 1 from the rear side via the tapering transverse opening 9. Then, the strap 25 is forced laterally into the longitudinal holes 3 horizontally from opposite sides via the respective longitudinal openings 7 so as to form a loop turning round the inner end of the inter-hole partition wall 5 and fixed in the connector body 1 with two ends of the strap 25 rendered in alignment with each other. Then, the two aligned ends of the strap 25 are knotted as shown in FIG. 4 or fastened by a non-illustrated clamp, completing the pull-tab connector.

In this embodiment, since the transverse rear opening 9 of the transverse through-hole 2 and the longitudinal openings 7 of the longitudinal holes 3 open in different directions, i.e., perpendicularly to each other, the round strap 25 is free from being removed off the connector body 1 by accident.

Figure 10:
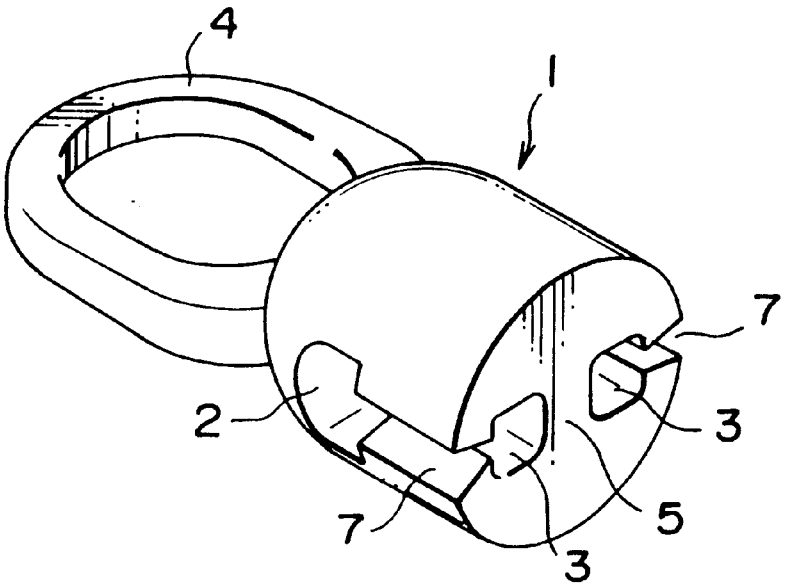
FIG. 10 is a perspective view of a cylindrical connector body of a still further pull-tab connector according to a fifth embodiment of the invention.

FIG. 10 shows a still further pull-tab connector according to a fifth embodiment of the invention. This embodiment is differentiated from the first embodiment of FIGS. 1 through 3 only in that the right-angle hexahedral connector body 1 of the first embodiment is substituted by a cylindrical connector body 1 with one hemispherical end from which a connecting ring 4 projects. Namely, the transverse through-hole 2 extends diametrically through the cylindrical connector body 1 at a position toward the connecting ring 4, and the two longitudinal holes 3 extends parallel to the axis of the cylindrical connector body 1 so as to communicate perpendicularly to the transverse through-hole 2. Each of the longitudinal holes 3 opens radially in opposite directions to the circumferential surface of the cylindrical connector body 1 via the respective tapering longitudinal openings 7.

For threading the round strap 25 through and turning it in cylindrical the connector body 1, firstly one end of the round strap 25 is inserted through the transverse through-hole 2 of the connector body 1. Then the strap 25 is forced laterally into the longitudinal holes 3 radially inwardly from opposite sides via the respective longitudinal openings 7 so as to form a loop turning around inner end of the inter-hole partition wall 5 and is with two ends of the strap 25 rendered in alignment with each other. Then, the two aligned ends of the strap 25 are knotted as shown in FIG. 4 or fastened by a non-illustrated clamp, completing the pull-tab connector. Alternatively, the transverse through-hole 2 may open to the circumferential surface of the cylindrical connector body 1 via a radially inwardly tapering transverse rear inlet opening (not shown), and/or the longitudinal openings 7 of the longitudinal holes 3 may be substituted by a pair of radially inwardly tapering longitudinal rear inlet openings (not shown).

Figure 11:
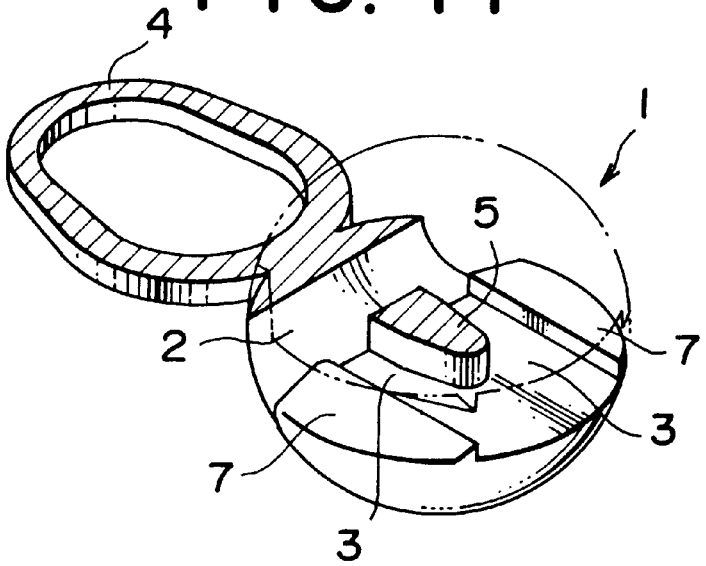
FIG. 11 is a perspective view, partly in cross section along an imaginary horizontal plane, of a spherical connector body of a still further pull-tab connector according to a sixth embodiment of the invention.

FIG. 11 shows an additional pull-tab connector according to a sixth embodiment of the invention. This embodiment is differentiated from the fifth embodiment of FIG. 10 only in that the cylindrical connector body 1 of FIG. 10 is substituted by a spherical connector body 1, from an surface of which a connecting ring 4 projects. Namely, the transverse through-hole 2 extends through the spherical connector body 1 at a position toward the connecting ring 4. The two longitudinal holes 3 extend from the side opposite to the connector ring 4 to the transverse through-hole 2 and opens radially in opposite directions to the circumferential surface of the spherical connector body 1 via the respective radially inwardly tapering longitudinal openings 7. These two longitudinal holes 3 merge at their outer ends opposite to the connecting ring 4. The inter-hole partition wall 5 is formed short of the outer ends of the longitudinal holes 3.

For threading the round strap 25 through and turning it in the spherical connector body 1 firstly one end of the round strap 25 is inserted through the transverse through-hole 2 of the connector body 1 from one side. Then, the strap 25 is forced laterally into the longitudinal holes 3 from opposite sides via the respective longitudinal openings 7 so as to form a loop turning around inner end of the inter-hole partition wall 5 and fixed in the connector body 1 with two ends of the strap 25 rendered in alignment with each other. Then, the two aligned ends of the strap 25 are knotted as shown in FIG. 4 or fastened by a non-illustrated clamp, completing the pull-tab connector.

Figure 12:
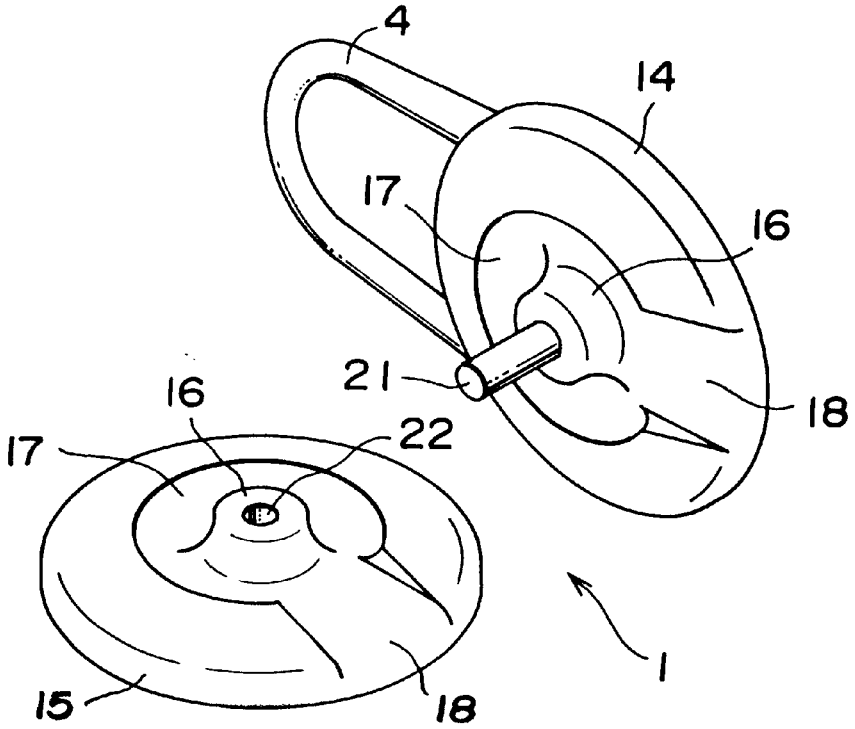
FIG. 12 is an exploded perspective view of a disc-like connector body of a still another pull-tab connector according to a seventh embodiment of the invention.
Figure 13:
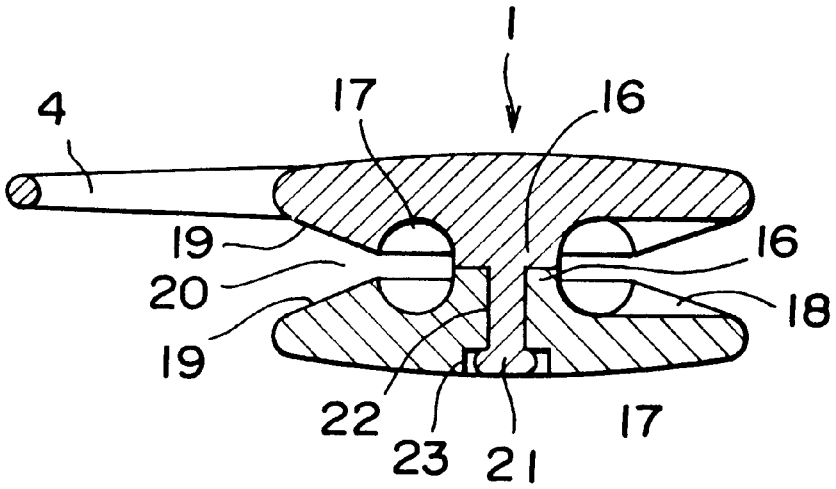
FIG. 13 is a longitudinal cross-sectional view, taken along an imaginary vertical plane, of the disc-like connector body of the seventh embodiment in an assembled form.
Figure 14:
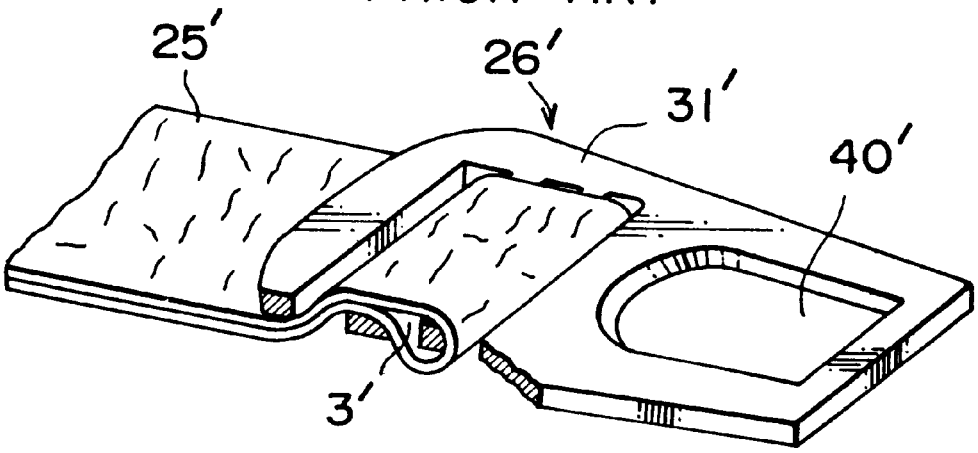
FIG. 14 PRIOR ART
FIG. 14 is a fragmentary perspective view of a conventional pull tab using a flat strap.
Figure 15:
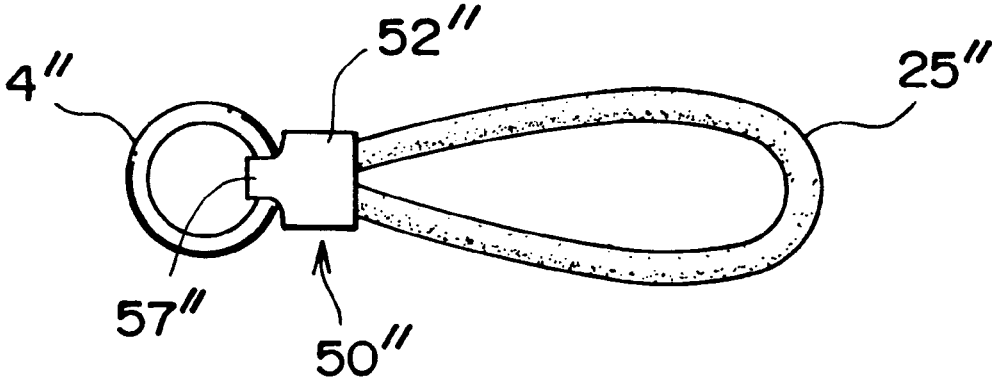
FIG. 15 PRIOR ART
FIG. 15 is a plan view showing another conventional pull tab using a round strap.

FIGS. 12 and 13 show still another pull-tab connector according to a seventh embodiment of the invention. This embodiment is differentiated from the foregoing embodiments in that the connector body 1 is composed of front and rear disc-like plates 14, 15 that are separably coupled by a hub 16. The front and rear disk-like plates 14, 15 jointly have in their confronting surfaces a semicircular-cross-section annular strap-insertion hole 17 extending about the hub 16 and open in all directions to the outer periphery of the disc-like connector body 1 via a radially inwardly tapering annular peripheral inlet opening (hereinafter also called the peripheral opening) 20, and an oval-cross-section radial strap-insertion hole (hereinafter also called the radial hole) 18 extending perpendicularly to the annular hole 17 across the peripheral opening 20. The peripheral opening 20 is defined by a set of upper and lower outwardly diverging slopes sloping down to the outer periphery of the front and rear disc-like plates 14, 15. The front and rear disk-like plates 14, 15, when joined together, define by their respective inner surfaces halves of the longitudinal hole 17, halves of the radial hole 18 and halves of the peripheral opening 20. A connector ring 4 integrally projects from the periphery of the front disk-like plate 14.

The hub half 16 of the rear disc-like plate 15 has an axial hole 22, and the hub half 16 of the front disc-like plate 14 has an axial projection 21 to be fitted in the axial hole 22. For coupling the front and rear disc-like plates 14, 15 together, firstly the projection 21 is inserted into the axial hole 22 of the rear disk-like plate 15 until its free end projects into a recess 23 provided in the outer surface of the rear disk-like plate 15, whereupon a projecting free end of the axial projection 21 is clenched to fixedly secure the front and rear disk-like plates 14, 15 to one another.

For threading the round strap 25 through and turned it in the double-plate connector body 1, firstly the round strap 25 is radially forced into the annular hole 17 via the peripheral opening 20, and turned round the hub 16. Then, the opposite ends of the strap 25 are inserted into the radial hole 18. Finally the opposite ends of the strap 25 are set in lateral alignment and are knotted as shown in FIG. 4 or fastened by a non-illustrated clamp, completing the pull-tab connector.

The pull-tab connectors of the present invention have the following advantageous results:

According to the first aspect of the invention, partly since the connector body 1 has a transverse strap-insertion through-hole 2 at position toward one ends from which a connecting ring 4 outwardly projects, and a pair of longitudinal strap-insertion 3 holes extending from the other end of the connector body 1 to the transverse through-hole 2 and opening to opposite sides of the connector body 1 via a pair of inwardly tapering longitudinal inlet openings 7, respectively, through their entire length, the round strap of the pull tab can be threaded through and turned in the connector body 1 simply and neatly without causing the strap to project in part from the surfaces of the connector body and can be exchanged with another as a demand arises.

According to the second, third and fourth aspects of the invention, since the longitudinal strap-insertion holes 3 open in opposite directions to opposite sides of the connector body 1 via the respective longitudinal inlet openings 7, or since the connector body 1 has an inwardly tapering transverse rear inlet opening 9 communicating at its inner side with the transverse strap-insertion through-hole 2 and opening at its outer side to a rear side of the connector body 1 while the longitudinal strap-insertion holes 3 open to the rear side of the connector body 1 via the respective longitudinal inlet openings 7, or since the connector body 1 has an inwardly tapering transverse inlet opening 7 communicating at its inner side with the transverse strap-insertion through-hole 2 and opening at its outer side to the rear side of the connector body 1, the round strap 25 can be threaded through and turned in any of various types of connector bodies 1 simply and can be exchanged with another as a demand arises.

According to the fifth, sixth and seventh aspects of the invention, since the contour of the connector body 1 may be right-angle-hexahedral, spherical or cylindrical, it is possible to guarantee a wide variety of selection of contour for the connector body 1, giving a different fashionable feature at every selection.

According to the eighth aspect of the invention, since the longitudinal strap-insertion holes 3 merge at their outer ends, threading and turning of the round strap 25 through and in the connector body 1 can be facilitated.

According to the ninth, tenth, thirteenth and fourteenth aspects of the invention, since the connecting ring 4 is fixed to the connector body 1, or since the connecting ring 4 is pivotally mounted on the connector body 1, the connector 1 can be applied to various types of the slider.

According to the eleventh aspect of the invention, since the connector body 1 has in their confronting surfaces a circular-cross-section annular strap-insertion hole 17 extending about the hub 16 and opening in all directions to the outer periphery of the disc-like connector body 1 via a radially inwardly tapering annular peripheral inlet opening 20, and an oval-cross-section radial strap-insertion hole 18 extending perpendicularly to the annular hole 17 across the peripheral opening 20, the round strap 25 of the pull tab can be threaded through and turned in the connector body 1 simply and neatly without causing the strap to project in part from the surfaces of the connector body and can be exchanged with another as a demand arises.

According to the twelfth aspect of the invention since the connector body is composed of separably coupled front and rear disc-like plates 14, 15 having in their confronting surfaces halves of the annular strap-insertion hole 17, halves of the peripheral inlet opening 20 and halves of the radial strap-insertion hole 18 and on their confronting surfaces halves of the hub 16, one half of the hub 16 having an axial hole 22 and the other half of the hub 16 having an axial projection 21 to be fitted in the axial hole 22, it is possible to manufacture the connector body 1 in a simple manner.

What is claimed is:

1. A pull-tab connector for connecting a round strap of a pull tab to a slide fastener slider, comprising:

(a) a connector body; and (b) a connecting ring disposed on one end of said connector body and adapted to be attached to the slide fastener slider;

(c) said connector body having a transverse strap-insertion through-hole, a pair of longitudinal strap-insertion holes communicating at their inner ends with said transverse strap-insertion through-hole and opening at their outer ends to the other end of said connector body opposite to said connector ring, and a pair of inwardly tapering longitudinal inlet openings each communicating at its inner side with a respective one of said longitudinal strap-insertion holes through its entire length and opening at its outer side to an outer surface of said connector body through its entire length.

2. A pull-tab connector according to claim 1, wherein said longitudinal strap-insertion holes open in opposite directions to opposite sides of said connector body via the respective longitudinal inlet openings.

3. A pull-tab connector according to claim 1, wherein said connector body has a transverse rear inlet opening communicating at its inner side with said transverse strap-insertion through-hole and opening at its outer side to a rear side of said connector body, said longitudinal strap-insertion holes opening to said rear side of said connector body via the respective longitudinal inlet openings.

4. A pull-tab connector according to claim 1, wherein said connector body has an inwardly tapering transverse rear inlet opening communicating at its inner side with said transverse strap-insertion through-hole and opening at its outer side to a rear side of said connector body.

5. A pull-tab connector according to claim 1, wherein said connector body has a right-angle hexahedral contour.

6. A pull-tab connector according to claim 1, wherein said connector body has a cylindrical contour with one hemispherical end.

7. A pull-tab connector according to claim 1, wherein said connector body has a spherical contour.

8. A pull-tab connector according to claim 1, wherein said longitudinal strap-insertion holes merge at their outer ends.

9. A pull-tab connector according to claim 1, wherein said connecting ring is fixed to said connector body.

10. A pull-tab connector according to claim 1, wherein said connecting ring is pivotally mounted on said connector body.

11. A pull-tab connector for connecting a round strap of a pull tab to a slide fastener slider, comprising:

(a) an annular connector body having a hub; and (b) a connecting ring disposed on an outer periphery of said connector body and adapted to be attached to the slide fastener slider;

(c) said connector body having an annular strap-insertion hole about said hub, a radially inwardly tapering annular peripheral inlet opening communicating at its inner side with said annular strap-insertion hole and opening at its outer side to said outer periphery of said connector body, and a radial strap-insertion hole disposed on a side opposite to said connecting ring and communicating at its inner end with said annular strap-insertion hole and opening at its outer end to said outer periphery of said connector body, said radial strap-insertion hole extending perpendicularly to said annular strap-insertion hole across said peripheral inlet opening.

12. A pull-tab connector according to claim 11, wherein said connector body is composed of separably coupled front and rear disk-like plates having in their confronting surfaces halves of said annular strap-insertion hole, halves of said peripheral inlet opening and halves of said radial strap-insertion hole, and on their confronting surfaces halves of said hub, one half of said hub having an axial hole and the other half of said hub having an axial projection to be fitted in said axial hole.

13. A pull-tab connector according to claim 11 or 12, wherein said connecting ring is fixed to said connector body.

14. A pull-tab connector according to claim 11 or 12, wherein said connecting ring is pivotally mounted on said connector body.

* * * * *